United States Patent [19]

Barnes et al.

[11] 4,292,763

[45] Oct. 6, 1981

[54] REFLECTIVE INSULATING BLINDS FOR WINDOWS AND THE LIKE

[75] Inventors: Paul R. Barnes, Lenoir City; Hanna B. Shapira, Oak Ridge, both of Tenn.

[73] Assignee: The United States of America as represented by the United States Department of Energy, Washington, D.C.

[21] Appl. No.: 101,367

[22] Filed: Dec. 7, 1979

[51] Int. Cl.[3] ..... E06B 7/08

[52] U.S. Cl. ..... 49/64; 49/92; 160/236

[58] Field of Search ..... 49/91, 92, 64; 160/236

[56] References Cited

U.S. PATENT DOCUMENTS

| | | | |
|---|---|---|---|
| 2,209,355 | 7/1940 | Schmitz | 160/236 X |
| 2,300,545 | 11/1942 | Gouch | 160/236 X |
| 2,366,339 | 1/1945 | Kump, Jr. | 49/64 X |
| 3,772,129 | 11/1973 | Dover | 160/236 X |
| 4,057,936 | 11/1977 | Wyatt, Jr. et al. | 49/91 X |

FOREIGN PATENT DOCUMENTS

| | | | |
|---|---|---|---|
| 267658 | 11/1963 | Australia | 49/92 |

*Primary Examiner*—Kenneth Downey
*Attorney, Agent, or Firm*—Louis M. Deckelman; Stephen D. Hamel; Richard G. Besha

[57] ABSTRACT

Energy-conserving window blinds are provided. The blinds are fabricated from coupled and adjustable slats, each slat having an insulation layer and a reflective surface to face outwardly when the blinds are closed. A range of desired light and air transmission may be selected with the reflective surfaces of the slats adapted to direct sunlight upward toward the ceiling when the blinds are open. When the blinds are closed, the insulation of the slats reduces the heat loss or gain produced by the windows. If desired, the reflective surfaces of the slats may be concave. The edges of the slats are designed to seal against adjacent slats when the blinds are closed to ensure minimum air flow between slats.

2 Claims, 6 Drawing Figures

REFLECTIVE INSULATING BLINDS FOR WINDOWS AND THE LIKE

It is the result of a contract with the U.S. Department of Energy.

BACKGROUND OF THE INVENTION

The present invention relates to energy-conserving blinds for use in the windows of a building, and more particularly, to improved construction of such blinds to reduce the heat loss or gain produced by the windows and to provide for minimum air flow between slats when the blinds are closed. As used herein, the term "window" applies to any glazed sunlight admitting opening.

The solar energy transmitted through large south-facing windows can provide a substantial contribution toward the heating requirements of residences and buildings. However, these same windows (as well as all glazed units) give rise to large heat losses during heating seasons and heat input during cooling seasons. The heat transfer is reduced approximately ½ through the use of doubly glazed units. Even so, the heat transfer is at least twice that of acceptably insulated wall systems. A further problem of large windows arises due to glare and to the fading of fabrics and furniture exposed to the sun.

Common partial solution to these problems has been the use of various types of blinds and drapes. Unfortunately, the use of such covering of the windows negates the potential solar input benefit. The covering at night does provide some insulation due to the multiple air layers. Typical of the coverings known in the art are drapes with metalized backing, roll-up shades and venetian blinds. The latter may have a reflective outer surface, and may be mounted between window layers as well as on the room side of the windows. Special screening is also available to install exterior to the window.

It is an object of the present invention to provide improved window blinds that not only provide reflection of sunlight upward toward the ceiling of a room during the daylight hours but also provide insulation for the room when they are closed for reducing the heat loss or gain produced by the windows.

It is another object of the present invention to provide reflective insulating blinds for windows that also provide a minimum air flow between th slats thereof when the blinds are closed.

Other objects, advantages and novel features of the invention will become apparent to those skilled in the art upon examination of the following detailed description of a preferred embodiment of the invention and the accompanying drawings.

SUMMARY OF THE INVENTION

The present invention relates to an improved window blind comprising multiple slats adapted to be adjusted simultaneously, each slat being formed of a base, an insulating layer, and a reflective surface applied to the exterior exposed surface of the insulating layer. In addition, the edges of each slat are adapted to be notched whereby interlocking of adjacent slats can be effected, and these notches are adapted to contain a respective sealant strip to assure close association of adjoining slats when the blind is in a closed position to thus ensure minimum air flow between slats. The reflective surface of each slat may be either flat or contoured across the width thereof to form a concave surface.

DESCRIPTION OF THE PREFERRED EMBODIMENTS

Figure 1:
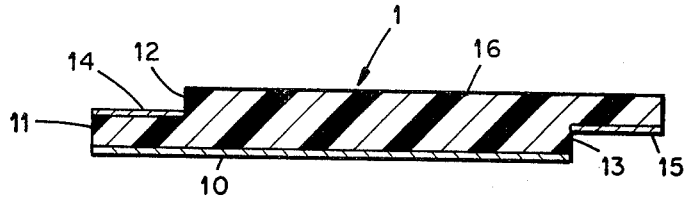
FIG. 1 is a cross sectional view of one slat of a window blind of the present invention to accomplish greater energy conservation.
Figure 2:
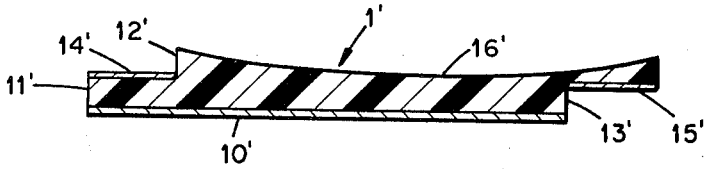
FIG. 2 is a cross sectional view of one slat of another embodiment of a window blind of the invention.

Two embodiments of reflective insulating blinds for windows and the like of the present invention are illustrated in FIGS. 1 and 2 of the drawings. These drawings are cross sectional views taken across a respective individual slat 1 or 1' of the blinds. A base material or frame 10 or 10' is provided to give adequate rigidity to the respective slat. Affixed to the outwardly facing surface of the base 10 or 10' is a relatively thick layer of insulation 11 or 11', such as styrofoam or polyurethane. (Alternatively, the insulation may contain internal strengthening elements.) The insulation 11 or 11' is provided with appropriate offsets 12, 13 or 12', 13' whereby adjacent slats will form a substantially continuous surface when the blind is in a closed position (see FIG. 4). The base of the offsets 12, 13 or 12', 13' are provided with a sealant strip 14, 15 or 14', 15' to assure a complete seal along the length between adjacent slats when closed. This sealant strip may be of a magnetic material or the like. The exposed face of the insulating material 11 or 11' is covered with a reflective surface 16 or 16'. The reflective surface may be, for example, a bonded layer of metal foil. In addition, the reflective surface 16 of FIG. 1 is flat, while the surface 16' of FIG. 2 is contoured. The outer face of the insulating material 11' may be similarly contoured.

Figure 3:
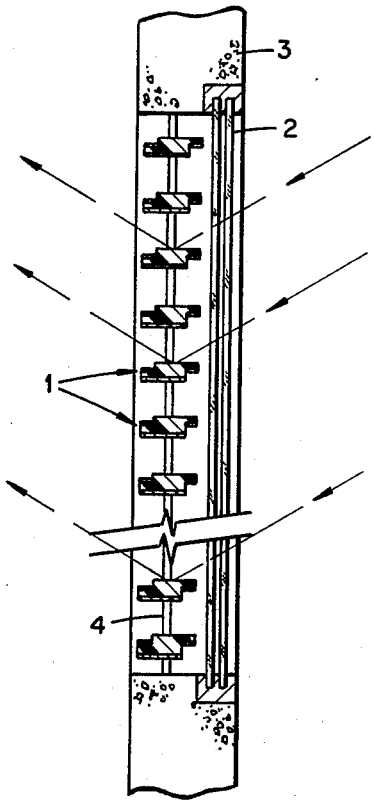
FIG. 3 is a vertical section of a window showing a window blind of the present invention in an open position.

FIG. 3 illustrates a window blind having slats, such as shown in FIG. 1, in one form of utilization. The blind is mounted on the inside of a double glass window 2 which is mounted within a vertically oriented window frame 3. The slats 1 of the blind are connected to a control rod 4, for example, which in turn is supported by the window frame 3. Mechanical means, not shown, are coupled to the rod 4 for effecting the opening and closing of the blind in a conventional manner. With the slats in a substantially horizontal position, incoming sunlight is reflected by the reflective surfaces of the slats 1 onto the ceiling of the room, not shown, in which the window frame 3 is mounted. Excess heat reaching the ceiling can be absorbed thereby and later radiated back into the room. In addition, the ceiling illumination effected by the reflected sunlight greatly decreases the dependence on artificial lighting. The use of the reflective slats in the blind thus permits nearly maximum solar energy input to the room (as in winter) without the accompanying glare and sunlight damage to furniture and rugs.

The use of the curved slats, such as shown in FIG. 2, instead of in flat slats of FIG. 1 in the window blind has the advantage that sunlight will be reflected to the ceiling much of the day without the necessity for making frequent changes in the slant of the slats.

Figure 4:
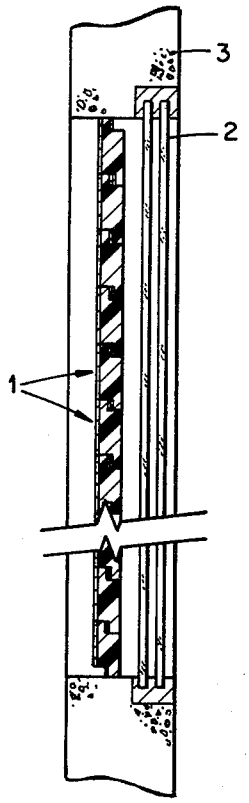
FIG. 4 is a vertical section of the window blind of FIG. 3 in a closed position.

The closed position of the slats of FIG. 3 is illustrated in FIG. 4. In this position any sunlight is reflected away from the room and the insulation forms a continuous insulating shutter to prevent heat transfer. This position would be used at night, particularly in winter, and during summer days where no sunlight is needed or desired in the room. Additional window insulation is provided by the air gap between the window and the closed blind.

Figure 5:
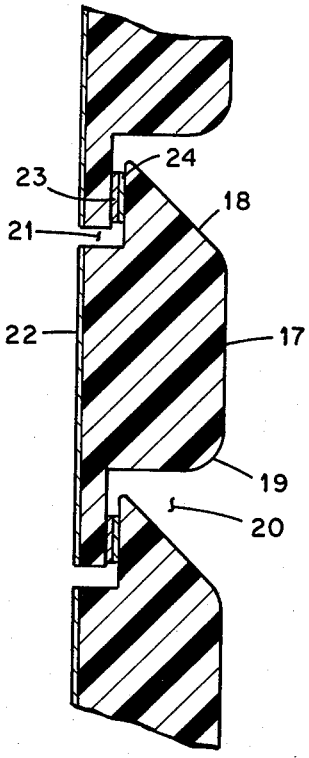
FIG. 5 is a partial showing of a vertical section of a window blind illustrating another embodiment of the present invention with reflective insulating slats in a closed position.

Still another embodiment of the present invention is illustrated in FIG. 5 of the drawings. The principle is the same as that for FIGS. 1 and 2; only the configuration is changed. In order to provide a thickness of insulation layer 17 which is sufficient to maintain proper shape, provision is made whereby the edge of the slats may move without striking an adjoining slat. This necessitates at least rounding the rearward edges 18, 19 as shown. Further, slanting edge 18 permits additional transmission of reflected energy when the slats are in an open position. The bases of the offsets of each slat are provided with sealant strips 23, 24, or the like, for the same purpose as in the embodiments of FIGS. 1 and 2.

Although some loss of insulation results in utilizing the slanting edges 18 for the slats, pockets of dead air 20 will be created in the notches between slats to compensate for the loss. A spacing 21 is provided between forward edges whereby interlocking of slats is assured even when some misalignment exists. The slats are provided with a respective reflective surface 22 which may, if desired, be curved as in FIG. 2.

Figure 6:
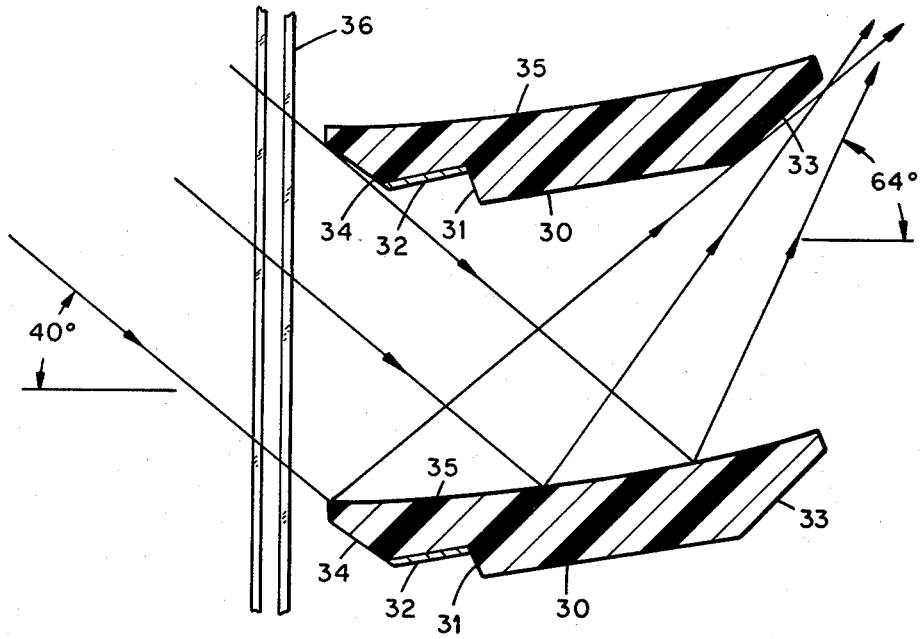
FIG. 6 is a partial showing of still another embodiment of the present invention with reflective insulating slats of a window blind shown in an opened position.

Still another embodiment of the present invention is illustrated in FIG. 6 of the drawings. Only two slats of the blind are shown in FIG. 6 and the blind is mounted on the inside of a double glass window 36. The slats are shown in the open position to illustrate the direction of the incoming sunlight during the daytime and how it is reflected by the reflective face of one of the slats, for example, toward the ceiling. Each of the slats of FIG. 6 is comprised of a thick layer of insulation 30 and is provided with an offset 31. The base of each of the offsets is provided with a sealant strip 32. The ends of each of the insulation layers 30 of the respective slats are provided with slanting edges 33, 34 as shown. The exposed contoured face of the insulation material 30 of each slat is covered with a reflective surface 35.

It can be seen that when the blind of FIG. 6 is tilted to a closed position, an upper right hand portion of the curved face of a lower slat will abut against the sealant strip 32 of the adjacent upper slat such that when all of the slats of the blind are sealed in this manner, the insulation of the closed slats forms a substantially continuous insulating shutter to prevent heat transfer as in the other embodiments described above. It should be understood that the sealant strip 32 is adapted to be curved to match the curvature of the portion of the adjacent slat that abuts against it when the blind is closed. It should be understood that the upper faces of the slats of FIG. 6 could be made flat if such is desired.

The various embodiments described above were designed for interior mounting in a vertical sunlight-admitting opening. It should be understood that the various blinds could be adapted for mounting in rooms provided with ceiling skylight openings if such were desired. In addition, the blinds could be mounted on the exterior of various building openings, if such were desired, particularly in temperate regions. However, interior mounting of the blinds is preferred, particularly in colder climates where freezing could interfere with the control mechanisms of the blinds.

In order to provide greater visibility than the conventional venetian blind, the blinds of the present invention utilizing the slats of FIGS. 1, 2, 5 or 6 may be made wider. For example, the width of each slat is made 3.5 inches (8.89 cm) as compared to a conventional venetian blind slat of about 2 inches (6.35 cm) width. Also, since the slats are constructed to be rigid, they can easily be wiped clean with a cloth when necessary. When the slats are curved, as in FIG. 2 or FIG. 6, each curved slat is provided with a curvature of 12 inch (30.49 cm) radius, for example, and it has been determined that such a curvature reduces the number of adjustments required for the blind to achieve the desired reflective angle during the daylight hours. It should be understood that any necessary or desired adjustment of the blind may be either manual, as mentioned above, or by means of an automated remote-control device.

It has been determined that the use of the reflective insulation blinds of the present invention will effect a saving of 70–80 kWhr/m$^2$ during an average heating season in the East Tennessee area.

The foregoing description of preferred embodiments of the invention has been presented for purposes of illustration and description and is not intended to be exhaustive or to limit the invention to the precise forms disclosed. They were chosen and described in order to best explain the principles of the invention and their practical application to thereby enable others skilled in the art to best utilize the invention in various embodiments as are suited to the particular use contemplated. It is intended that the scope of the invention be defined by the claims appended hereto.

What is claimed is:

1. In combination with a window for transmitting sunlight into a room, an improved blind comprising a plurality of coupled, horizontally extending thermally insulating slats, each having a front face, a rear face, and a pair of longitudinally extending edge faces, each front face being a reflective transversely concave surface, said slats being rotatable about their axes between (1) a blind-closed position where adjacent slats are in partially overlapping relation and form a substantially continuous, generally vertical surface for providing window insulation and (2) a blind-open position where said slats are in spaced, superimposed relation, with their reflective concave surfaces facing upward and directly exposed to said sunlight, said reflective surfaces having a curvature reflecting most of said sunlight incident thereon directly onto the ceiling of said room to maximize solar energy input to the room while minimizing glare, the transitions between each of said edge faces of a slat and said back face thereof being sloped toward each other to enlarge the light-entrance and light-exit regions defined by adjacent slats.

2. The window blind of claim 1, wherein the back face of each of said slats is recessed longitudinally to receive a sealing strip for mating with the front face of an adjacent slat when said slats are closed position.

* * * * *